United States Patent [19]

Crum et al.

[11] Patent Number: 4,830,279

[45] Date of Patent: May 16, 1989

[54] FLAT SPRAY NOZZLE FOR A SPRAY GUN

[75] Inventors: Gerald W. Crum; John C. Traylor, both of Elyria, Ohio

[73] Assignee: Nordson Corporation, Westlake, Ohio

[21] Appl. No.: 99,075

[22] Filed: Sep. 21, 1987

[51] Int. Cl.[4] ..... B05B 5/00; B05B 1/14

[52] U.S. Cl. ..... 239/3; 239/568; 239/597; 239/601; 239/696; 239/707

[58] Field of Search ..... 239/704, 706, 707, 708, 239/568, 3, 601, 597, 696, 690

[56] References Cited

U.S. PATENT DOCUMENTS

| | | | |
|---|---|---|---|
| Re. 31,867 | 4/1985 | Kennon . | |
| 1,094,124 | 4/1914 | Coen | 239/568 |
| 1,753,443 | 4/1930 | Murray | 239/597 |
| 2,302,289 | 11/1942 | Bramston-Cook . | |
| 3,116,020 | 12/1963 | Rosen et al. . | |
| 3,195,819 | 7/1965 | Watanabe | 239/696 |
| 3,263,127 | 7/1966 | Point et al. . | |
| 3,335,956 | 8/1967 | James | 239/568 |
| 3,416,736 | 12/1968 | Marik | 239/568 |
| 3,556,411 | 1/1971 | Nord et al. . | |
| 3,590,318 | 6/1971 | Probst et al. . | |
| 3,617,000 | 11/1971 | Probst et al. . | |
| 3,659,151 | 4/1972 | Fabre | 239/3 |
| 3,659,787 | 5/1972 | Ito . | |
| 3,731,145 | 5/1973 | Senay . | |
| 3,747,850 | 7/1973 | Hastings et al. . | |
| 3,747,852 | 7/1973 | Nord et al. . | |
| 3,911,161 | 10/1975 | Nord et al. . | |
| 4,214,709 | 7/1980 | Scull et al. | 239/707 |
| 4,241,880 | 12/1980 | Hastings . | |
| 4,266,721 | 5/1981 | Sickles | 239/3 |
| 4,273,293 | 6/1981 | Hastings . | |
| 4,294,411 | 10/1981 | Hastings et al. . | |
| 4,335,851 | 6/1982 | Hastings . | |
| 4,346,849 | 8/1982 | Rood . | |
| 4,349,947 | 9/1982 | Rood . | |
| 4,355,764 | 10/1982 | Rood et al. . | |
| 4,356,528 | 10/1982 | Coffee | 239/690 |
| 4,380,320 | 4/1983 | Hollstein et al. . | |
| 4,381,081 | 4/1983 | Hastings . | |
| 4,478,370 | 10/1984 | Hastings . | |
| 4,502,629 | 3/1985 | McGhee et al. . | |
| 4,544,100 | 10/1985 | Simashkevich et al. . | |
| 4,572,438 | 2/1986 | Traylor . | |
| 4,576,827 | 3/1986 | Hastings et al. . | |
| 4,579,286 | 4/1986 | Stoudt . | |
| 4,598,871 | 7/1986 | Hartle . | |
| 4,611,762 | 9/1986 | Turner et al. . | |
| 4,613,083 | 9/1986 | Mulder et al. | 239/707 |
| 4,630,777 | 12/1986 | Hollstein et al. . | |
| 4,638,951 | 1/1987 | Gabriel . | |

FOREIGN PATENT DOCUMENTS

| | | |
|---|---|---|
| 196807 | 3/1958 | Austria . |
| 0126688 | 11/1984 | European Pat. Off. . |
| 0237207 | 9/1987 | European Pat. Off. . |
| 2125217 | 6/1970 | Fed. Rep. of Germany . |
| 46200 | 1/1888 | German Democratic Rep. . |

*Primary Examiner*—Andres Kashnikow
*Assistant Examiner*—Christopher G. Trainor
*Attorney, Agent, or Firm*—Wood, Herron & Evans

[57] ABSTRACT

A flat spray nozzle for a powder spray gun comprises a nozzle body formed with an axial powder flow passageway, a pair of spaced powder discharge slots intersecting the powder flow passageway and a bore located between the powder discharge slots. The bore in the nozzle body receives an electrode which extends forwardly of the spray nozzle, between the powder discharge slots for electrostatically charging particulate powder material emitted from the powder discharge slots without disrupting the spray pattern of particulate powder material.

11 Claims, 1 Drawing Sheet

FLAT SPRAY NOZZLE FOR A SPRAY GUN

FIELD OF THE INVENTION

This invention relates to powder spray guns, and, more particularly, to a flat spray nozzle for a powder spray gun which produces a uniform, sharply defined spray pattern upon an object to be coated.

BACKGROUND OF THE INVENTION

In industrial finishing applications, coating particles are emitted from a spray device such as a spray gun toward an object to be coated. One type of coating material is in the form of particulate powder entrained in a stream of air. The process of spraying products with a solid powder coating involves preparing the powder coating in finely ground form and spraying it onto the parts in a manner similar to liquid paint. Conventionally, but not necessarily, an electrostatic charge is supplied to the powder as it is sprayed toward an object to be coated. The object to be coated is maintained at an electrostatic potential different than that from the charged powder particles so that the particulate powder material is attracted to the article and deposited thereon with approved efficiency and coverage. The electrostatic charge maintains the powder on the product for a sufficient time period to permit the powder to be heated so that it melts, and when the powder is subsequently cooled it is firmly attached to the target substrate.

Powder spray guns generally comprise a barrel formed with a powder flow passageway and a spray nozzle mounted at the forward end of the barrel. The spray nozzle may be formed with a generally circular-shaped discharge opening through which powder coating particles are emitted to form a generally conical-shaped spray pattern upon an object to be coated. Alternatively, the spray nozzle is formed with a generally rectangular-shaped slot through which the powder coating particles are discharged to form a so-called "flat" spray pattern, i.e., a spray pattern with relatively sharply defined, parallel edges. An electrode is often mounted at the forward end of the spray gun, in the vicinity of the discharge opening in the spray nozzle, to impart an electrostatic charge to the powder coating particles emitted from the spray nozzle.

In order to maximize coverage of a target object with coating particles, it is desirable to create a strong electrostatic field between the electrode and target object so the coating particles are efficiently charged and then strongly attracted to the target object. It has been found that this electrostatic field is strengthened by positioning the electrode forwardly of the spray nozzle and the discharge opening therein.

In prior art "flat" spray nozzles, i.e., those having a rectangular discharge opening, the electrode has been positioned forwardly of the spray nozzle but this has resulted in undesirable interaction between the pattern forming structure and charging structure with a resulting loss of performance in one or both. For example, if the electrode is positioned in the path of particulate powder material emitted from the slotted discharge opening in order to increase charging efficiency, the spray pattern on the object to be coated is disrupted. Movement of the electrode out of the path of the powder material, as disclosed, for example, in U.S. Pat. No. 4,630,777, avoids disruption of the spray pattern but the charging efficiency decreases to some degree.

Another approach in prior art electrostatic spray guns employing a flat spray nozzle has been to position the electrode within the interior of the nozzle. This avoids disruption of the spray pattern, but substantially weakens the electrostatic field between the electrode and target object because the electrode is shielded by the nozzle. Additionally, where the electrode is positioned inside of the spray nozzle, an ignition hazard can be created by a sudden capacitive discharge between the electrode and a grounded object. Whereas an electrode positioned outside of the spray nozzle forwardly of the gun gradually discharges as a grounded object approaches, an electrode positioned internally of the spray nozzle may be partially or completely shielded from an approaching grounded object. As a result, the grounded object can "sneak up" on the electrode, i.e., approach the electrode while being shielded by the nozzle, and thus cause a sudden, relatively high energy capacitive discharge from the electrode to the grounded object. A high energy capacitive discharge can result in a spark or arc between the electrode and grounded object and ignite the volatile, potentially explosive environment in which powder spray guns are operated.

Another problem with flat spray nozzles employing a single, rectangular-shaped discharge slot or opening is that the spray pattern on the target object is often non-uniform. In many instances, the center or middle of the pattern is "heavy", i.e., has a concentration of particulate powder material. Alternatively, or in addition to a concentration at the center of the pattern, the edges of the pattern in prior art flat spray nozzles often do not decrease uniformly to allow for overlapping of patterns from adjacent spray guns without a "striping" effect, i.e., a buildup of powder at the overlapping edges.

SUMMARY OF THE INVENTION

It is therefore among the objectives of this invention to provide an electrostatic spray gun having a flat spray nozzle which provides for efficient electrostatic charging of coating particles emitted from the nozzle, and which avoids sudden capacitive discharge between the electrode of the spray gun and a nearby grounded object.

It is a further objective of this invention to provide a flat spray nozzle for use with a powder spray gun which produces a uniform pattern of coating particles on an object to be coated.

These objectives are accomplished in a powder spray gun having a flat spray nozzle mounted to the forward end of the gun barrel which is formed with an axial powder flow passageway and a pair of spaced rectangular powder discharge slots which intersect the powder flow passageway and extend generally parallel to one another. In a presently preferred embodiment, a throughbore is formed in the spray nozzle between the powder discharge slots which receives a single point electrode in the form of a pin mounted to an electrostatic cable assembly. The electrode extends through the throughbore of the spray nozzle, forwardly of the gun, and between the two discharge slots in the spray nozzle.

One aspect of this invention is predicated on the concept of positioning an electrode forwardly of the spray gun, in the path of the air-entrained particulate powder material emitted from the spray nozzle, without disrupting the uniformity of the spray pattern of powder material on a target object. This is achieved by providing two spaced discharge slots, instead of the conventional single discharge slot, which are positioned on either side of the electrode so that the resulting spray pattern is unaffected by the presence of the electrode forwardly of the gun and a uniform spray pattern is produced on the target object. Positioning the electrode forwardly of the spray nozzle also has the advantage of producing a strong electrostatic field between the electrode and the object to be coated for efficiently charging the coating particles emitted from the spray nozzle. Additionally, the forward position of the electrode allows it to gradually discharge in the event a grounded object is brought near to the gun which prevents a sudden capacitive discharge between the electrode and such grounded object.

In the presently preferred embodiment, the powder spray gun is formed with a powder flow passageway within which a cable assembly is axially adjustable. The cable assembly comprises a dielectric cable liner having a hollow interior within which a high voltage electrostatic cable is mounted. The cable assembly is carried by a cable mount at the forward end of the spray gun and an axial adjustment assembly at the rearward end of the spray gun. An electrode is supported at the forward end of the cable liner which is electrically connected to the electrostatic cable. The cable assembly is mounted within the powder flow passageway in the spray gun in a position so that the electrode extends through the center bore in the spray nozzle, forwardly of the spray gun. In this position, the electrode produces a highly concentrated electrostatic field between it and the target object to ensure efficient charging of particle powder material emitted from the nozzle.

An adaptor is carried on the forward end of the gun, which, in turn, mounts the flat spray nozzle. The adaptor is formed with a throughbore having a radially inwardly tapering inner wall located upstream from the discharge slots in the spray nozzle and downstream from the cable mount. The tapered wall of the adaptor uniformly distributes the particulate powder material after it contacts the cable mount to ensure homogeneity in the air-entrained powder stream delivered to the discharge slots in the flat spray nozzle. This uniform mixing of the particulate powder material within the conveying air stream is important to obtain a uniform spray pattern having a gradually decreasing concentration of particulate powder material at the edges of the pattern. Uniformity of the spray pattern is also enhanced by the separation between the two discharge slots which have a tendency to thin out the concentration of powder material at the center of the spray pattern and avoid a buildup thereat.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1:
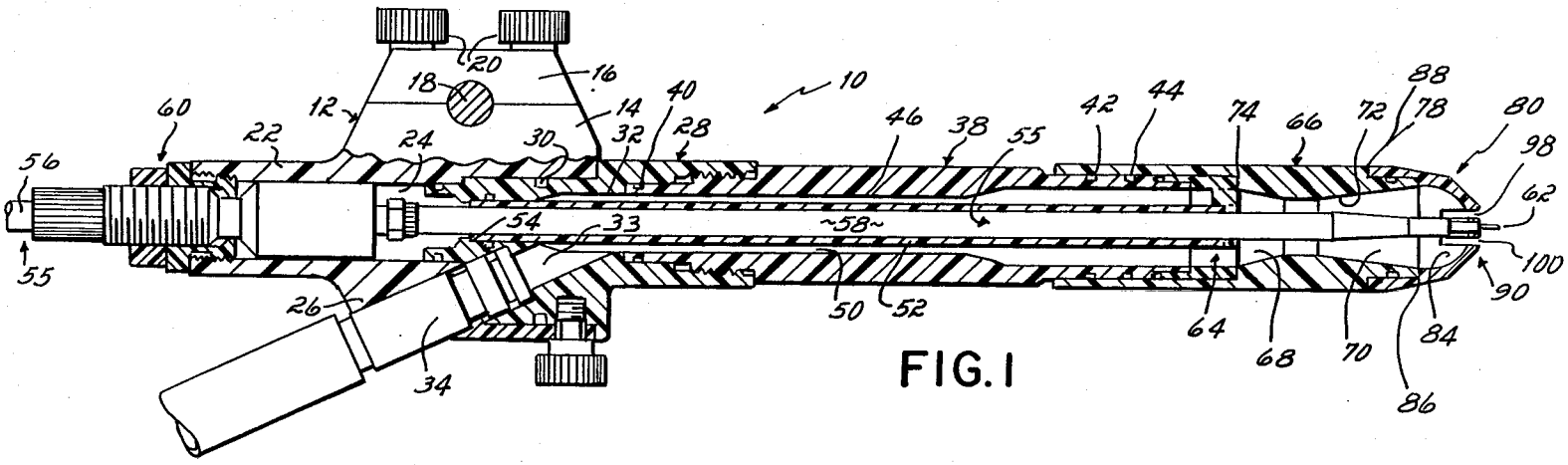
FIG. 1 is a cross sectional view of the assembled spray gun of this invention.

Referring now to FIG. 1, a spray gun 10 for spraying particulate powder material is illustrated which is disclosed in detail in U.S. patent application Ser. No. 99,495, filed simultaneously herewith, and entitled "Powder Spray Gun For Quick Color Change Systems", which is incorporated by reference in its entirety herein. Reference should be made to the disclosure of that application for a detailed discussion of the construction of spray gun 10.

For purposes of the present discussion, the spray gun 10 comprises a mounting block 1 having a base 14 and a cap 16. The base 14 and cap 16 are each formed with a notch which together define a bore adapted to receive a mounting rod 18 for supporting the powder spray gun 10. The base 14 and cap 16 are mounted to one another by screws 20.

The base 14 of mounting block 12 is formed with an inlet 22, a forward cavity 24 and a sleeve 26 which intersects the cavity 24. The term "forward" as used herein refers to the righthand portion of the spray gun 10 as viewed in FIG. 1, and the term "rearward" refers to the lefthand portion thereof.

A rearward barrel member 28 is slidably mounted within the cavity 24 of mounting block 12 where it is secured along the cavity wall by an O-ring 30 carried on the outer surface of rearward barrel member 28. The rearward barrel member 28 is formed with a throughbore 32, and an angled bore 33 which aligns with the sleeve 26 in the base 14 of mounting block 12. A powder supply tube 34 is inserted through the sleeve 26 in the mounting block 12 and then into the angled bore 33 of rearward barrel member 28 where it is secured in place. The powder supply tube 34 is effective to introduce air-entrained, particulate powder material through the angled bore 33 into the throughbore 32 of the rearward barrel member 28.

The forward end of the rearward barrel member 28 is internally threaded to receive mating threads on the rearward end of a forward barrel member 38. The outer surface of the forward barrel member 38 carries an O-ring 40 which engages the rearward barrel member 28. A pair of O-rings 42, 44 are carried on the outer surface of the forward barrel member 38 at its forward end. The forward barrel member 38 is formed with a throughbore 46 which is adapted to axially align with the throughbore 32 of rearward barrel member 28 to form a powder flow passageway 50 for transmitting particulate powder material from the powder supply tube 34 toward the forward end of the spray gun 10.

A barrel liner 52 extends axially within the powder flow passageway 50 which is mounted at its rearward end to a seat 54 formed in the rearward barrel member 28. The barrel liner 52 receives and supports a cable assembly 55 which comprises a high voltage electrostatic cable 56 mounted within the hollow interior of a dielectric cable liner 58. An electrode 62 is mounted at the forward end of the cable liner 58 in electrical contact with the electrostatic cable 56. The rearward end of the cable assembly 55 is mounted to the inlet 22 of mounting block 12 by a cable adjustment assembly 60. The forward end of cable assembly 55 is carried by a cable mount 64 located at the forward end of the forward barrel member 38. The details of the construction of the cable assembly 55, and the cable adjustment assembly 60, form no part of this invention per se and are disclosed in co-pending application Ser. No. 07/554,746, filed May 27, 1987, and entitled "Electrostatic Spray Gun Device and Cable Assembly", invented by Sharpless et al, which is incorporated by reference in its entirety herein.

An adaptor 66 is carried on the forward end of the forward barrel member 38. The adaptor 66 is formed with an hourglass-shaped throughbore including an enlarged diameter rearward portion 68 and a forward portion 70 having radially inwardly tapering inner wall 72. The rearward portion 68 forms an annular shoulder 74 which engages the forward end of the forward barrel member 38. The forward end of adaptor 66 is formed with an annular shoulder 78.

Figure 3:
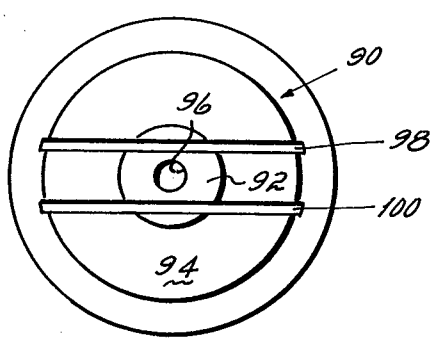
FIG. 3 is a front view of the spray nozzle shown in FIG. 2.
Figure 2:
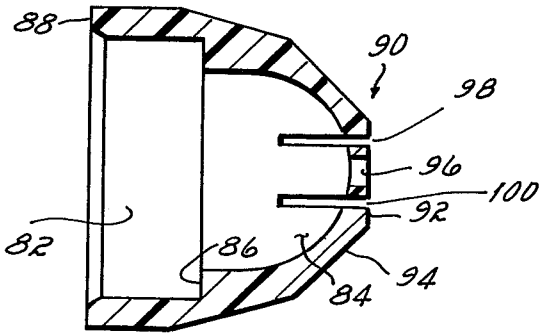
FIG. 2 is an enlarged cross sectional view of the spray nozzle add adaptor herein.

Referring now to FIGS. 22 and 3, a spray nozzle 80 is adapted to mount to the forward end of adaptor 66. The spray nozzle 80 is formed with a stepped, axial throughbore including an enlarged diameter rearward portion 82 and a truncated spherical portion 84 with an annular shoulder 86 therebetween. The spray nozzle 80 is mounted to the adaptor 66 so that the rearward edge 88 thereof contacts the shoulder 78 of the adaptor 66, and the annular shoulder 86 abuts the forward end of adaptor 66.

The tip 90 of spray nozzle 80 comprises a generally circular center section 92 and an outer section 94 which tapers radially outwardly from the center section 92. The center section 92 of tip 90 is formed with a bore 96 colinear with the longitudinal axis of the spray nozzle 80. An upper discharge slot 98 and a lower discharge slot 100 are formed in the nozzle tip 90 on opposite sides of the bore 96, equidistant therefrom. As best shown in FIG. 3, the upper and lower discharge slots 98, 100 are generally rectangular in cross section and extend along the width of the center section 92 and outer section 94 of the nozzle tip 90. These upper and lower discharge slots 98, 100 emit particulate powder material received from the powder flow passageway 50 in the spray gun 10.

As viewed in FIGS. 1 and 3, the electrode 62 mounted at the forward end of the cable assembly 55 extends through the bore 96 in the nozzle tip 90 and extends forwardly of the spray nozzle 94 between the upper and lower discharge slots 98, 100.

In operation, particulate powder material is introduced into the powder flow passageway 50 of spray gun 10 through the powder supply tube 34 carried in the rearward barrel member 28. The particulate powder material flows into the adaptor 66 where the hourglass-shaped throughbore contacts the coating particles. The inner wall 72 is effective to uniformly mix and distribute the air-entrained coating particles within the cross section of the throughbore in adaptor 66 to eliminate the effect of the cable mount 64 on the powder flow which has a tendency to segregate the particle powder material on the outer portion of the powder flow passageway 50. The coating particles, having been uniformly mixed within the adaptor 66, then enter the axial throughbore or powder flow passageway of spray nozzle 80. The spherical portion 84 of the spray nozzle 80 accelerates the particulate powder material received from the adaptor 66, which is then emitted from the upper and lower discharge slots 98, 100.

The electrode 62, extending forwardly of the spray nozzle 80, produces a strong electrostatic field between it and an object to be coated (not shown). Coating particles emitted from the upper and lower discharge slots 98, 100 are therefore effectively charged by the electrode 62, and these charged particles are then attracted to the target object. The upper and lower discharge slots 98, 100 are spaced on either side, equidistant from the electrode 62 to avoid interference with the spray pattern of particulate powder material directed onto the target object. Although the spray pattern is initially split between the upper and lower discharge slots 98, 100, the particulate powder material combines to form a spray pattern in which the coating particles are uniformly distributed at the center of the pattern and uniformly decrease in concentration at the outer ends of the pattern.

While the invention has been described with reference to a preferred embodiment, it should be understood by those skilled in the art that various changes may be made and equivalents may be substituted for elements thereof without departing from the scope of the invention. In addition, many modifications may be made to adapt a particular situation or material to the teachings of the invention without departing from the essential scope thereof.

For example, the spray gun 10 has been described as including an electrode 62 extending forwardly of the nozzle 80 to electrostatically charge particulate powder material discharge from slots 98, 100. It is contemplated, however, that the spray gun 10 could be operated without an electrode and employ a spray nozzle 80 having spaced, parallel discharge slots with no bore or electrode therebetween.

Therefore, it is intended that invention not be limited to the particular embodiment disclosed as the best mode contemplated for carrying out this invention, but that the invention will include all embodiments falling within the scope of the appended claims.

We claim:

1. A powder spray nozzle for spraying particulate powder material, comprising:

a nozzle body formed with an axial powder flow passageway for receiving the particulate powder material;

said nozzle body being formed with at least two, spaced powder discharge slots intersecting said axial powder flow passageway, and a bore located between said powder discharge slots;

said bore being adapted to receive an electrode extending outwardly from said nozzle body for electrostatically charging particulate powder material emitted from said powder discharge slots.

2. The powder spray nozzle of claim 1 in which said powder flow passageway in said nozzle body comprises a first portion having a constant diameter and a second portion formed in a truncated, spherical shape, said powder discharge slots intersecting said second portion of said powder flow passageway.

3. The powder spray nozzle of claim 1 in which said powder discharge slots are each rectangular in shape.

4. The powder spray nozzle of claim 1 in which said nozzle body is formed with a forward end, said bore being formed in the center of said forward end, said powder discharge slots being formed on opposite sides of said bore and extending substantially parallel to one another.

5. An electrostatic spray device for spraying particulate powder material, comprising:

a barrel having a passageway for transmitting the particulate powder material, said passageway having a discharge end;

a cable assembly mounted within said passageway, said cable assembly including a tube formed with a hollow interior and an electrostatic cable secured within said hollow interior of said tube;

an electrode mounted at one end of said tube, said electrode being electrically connected to said electrostatic cable;

a spray nozzle mounted to said barrel at said discharge end of said passageway, said spray nozzle having a nozzle body formed with an axial powder flow passageway, at least two spaced powder discharge slots intersecting said powder flow passageway, and a bore located between said powder discharge slots, said bore receiving said electrode which extends outwardly from said nozzle body between said spaced powder discharge slots.

6. The electrostatic spray device of claim 5 in which each of said powder discharge slots is rectangular in shape.

7. The electrostatic spray device of claim 5 in which said nozzle body of said spray nozzle has a forward end, said bore being formed at the center of said forward end, said slots being formed on opposite sides of said bore and extending substantially parallel to one another.

8. An electrostatic spray device for spraying particulate powder material, comprising:

a barrel having a passageway for transmitting the particulate powder material, said passageway having a discharge end;

flow control means positioned at said discharge end of said passageway for evenly dispensing the coating material throughout said passageway and for decreasing the velocity of the powder material;

a cable assembly mounted within said passageway, said cable assembly including a tube formed with a hollow interior and an electrostatic cable secured within said hollow tube;

an electrode mounted at one end of said tube, said electrode being electrically connected to said electrostatic cable;

a spray nozzle mounted to said barrel at said discharge end of said passageway, said spray nozzle having a nozzle body formed with an axial powder flow passageway, a pair of spaced powder discharge slots intersecting said powder flow passageway, and a bore located between said powder discharge slots, said bore receiving said electrode which extends outwardly from said nozzle body between said spaced powder discharge slots.

9. The electrostatic spray device of claim 8 in which said flow control means comprises an adaptor mounted to said barrel at said discharge end of said passageway upstream from said spray nozzle, said adaptor having a throughbore which forms a radially inwardly tapered inner wall, said inner wall contacting the powder material to uniformly mix the particulate powder material within said throughbore and to decrease the velocity of the particulate powder material upstream from said powder flow passageway in said nozzle body of said spray nozzle.

10. The electrostatic spray device of claim 9 in which said adaptor is formed with an outer surface adapted to mount said spray nozzle.

11. The method of spraying a flat spray pattern of particulate powder material, comprising:

transmitting particulate powder material into the axial powder flow passageway of a spray nozzle; and spraying particulate powder material through spaced, parallel discharge openings formed in said spray nozzle which intersect said axial powder flow passageway;

electrostatically charging the particulate powder material emitted from said discharge openings with an electrode protruding through a bore formed in said spray nozzle between said discharge openings.

* * * * *

UNITED STATES PATENT AND TRADEMARK OFFICE

CERTIFICATE OF CORRECTION

PATENT NO. : 4,830,279

DATED : May 16, 1989

INVENTOR(S) : Gerald W. Crum and John C. Traylor

It is certified that error appears in the above-identified patent and that said Letters Patent is hereby corrected as shown below:

In column 4, line 14, "block 1" should be --block 12--.

In column 5, line 2, "07/554,746" should be --07/054,746--.

In column 6, line 47, after "charging", insert --the--.

In column 7, line 33, "coating" should be --powder--.

Signed and Sealed this

Seventeenth Day of April, 1990

*Attest:*

HARRY F. MANBECK, JR.

*Attesting Officer*

*Commissioner of Patents and Trademarks*